US011276515B2

(12) United States Patent
Higashi et al.

(10) Patent No.: US 11,276,515 B2
(45) Date of Patent: Mar. 15, 2022

(54) VARISTOR AND METHOD FOR PRODUCING SAME

(71) Applicant: Panasonic Intellectual Property Management Co., Ltd., Osaka (JP)

(72) Inventors: Yoshiko Higashi, Osaka (JP); Eiichi Koga, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/286,909

(22) PCT Filed: Dec. 2, 2019

(86) PCT No.: PCT/JP2019/047079
§ 371 (c)(1),
(2) Date: Apr. 20, 2021

(87) PCT Pub. No.: WO2020/170545
PCT Pub. Date: Aug. 27, 2020

(65) Prior Publication Data

US 2021/0358663 A1 Nov. 18, 2021

(30) Foreign Application Priority Data

Feb. 22, 2019 (JP) ..... JP2019-029962

(51) Int. Cl.
*H01C 7/112* (2006.01)
*H01C 7/102* (2006.01)
*H01C 17/28* (2006.01)

(52) U.S. Cl.
CPC ..... *H01C 7/112* (2013.01); *H01C 7/102* (2013.01); *H01C 17/28* (2013.01)

(58) Field of Classification Search
CPC ..... H01C 7/112; H01C 7/102; H01C 17/28
See application file for complete search history.

(56) References Cited

U.S. PATENT DOCUMENTS 6,147,587 A * 11/2000 Hadano ..... H01C 7/10 338/21
2010/0136337 A1 6/2010 Ando et al.

FOREIGN PATENT DOCUMENTS

JP 62-124835 U 8/1987
JP 4-325413 11/1992
(Continued)

OTHER PUBLICATIONS

International Search Report of PCT application No. PCT/JP2019/047079 dated Feb. 10, 2020.

*Primary Examiner* — Kyung S Lee
(74) *Attorney, Agent, or Firm* — McDermott Will and Emery LLP

(57) ABSTRACT

A varistor includes an effective layer having first and second surfaces opposite to each other, a first ineffective layer stacked on the first surface of the effective layer, a second ineffective layer stacked on the second surface of the effective layer, and an external electrode. The effective layer includes a ceramic layer having a polycrystalline structure including crystal particles exhibiting voltage nonlinear characteristics, and internal electrodes stacked alternately on the ceramic layer. The thickness of the second ineffective layer is equal to or more than 1.1 times a thickness of the first ineffective layer and equal to or smaller than 6 times the thickness of the first ineffective layer. This varistor has a small size and excellent surge resistance.

13 Claims, 5 Drawing Sheets

(56) References Cited

FOREIGN PATENT DOCUMENTS

| | | | | | |
|---|---|---|---|---|---|
| JP | H08222470 | A | * | 8/1996 | |
| JP | 10-172809 | | | 6/1998 | |
| JP | 2000353636 | A | * | 12/2000 | |
| JP | 2008-218749 | | | 9/2008 | |
| JP | 2018-098413 | | | 6/2018 | |
| WO | WO-2020149034 | A1 | * | 7/2020 | ..... H01C 7/10 |
| WO | WO-2020194812 | A1 | * | 10/2020 | ..... H01C 7/112 |

* cited by examiner

VARISTOR AND METHOD FOR PRODUCING SAME

CROSS-REFERENCE TO RELATED APPLICATIONS

This application is a U.S. national stage application of the PCT international application No. PCT/JP2019/047079 filed on Dec. 2, 2019, which claims the benefit of foreign priority of Japanese patent application No. 2019-029962 filed on Feb. 22, 2019, the contents all of which are incorporated herein by reference.

TECHNICAL FIELD

The present invention relates to a varistor configured to protect, e.g. a semiconductor element from surge and static electricity.

BACKGROUND ART

When an abnormal voltage such as a surge and static electricity is applied to, for example, a semiconductor IC in an electronic device, the electronic device may malfunction or may be broken down. An electronic component for protecting an electronic device from such abnormal voltages may be a varistor. Conventional varistor is disposed in PTLs 1 and 2.

CITATION LIST

Patent Literature

PTL 1: Japanese Patent Laid-Open Publication No. 2008-218749

PTL 1: Japanese Patent Laid-Open Publication No. 4-325413

SUMMARY

A varistor includes an effective layer having first and second surfaces opposite to each other, a first ineffective layer stacked on the first surface of the effective layer, a second ineffective layer stacked on the second surface of the effective layer, and an external electrode. The effective layer includes a ceramic layer having a polycrystalline structure including crystal particles exhibiting voltage nonlinear characteristics, and internal electrodes stacked alternately on the ceramic layer. The thickness of the second ineffective layer is equal to or more than 1.1 times a thickness of the first ineffective layer and equal to or smaller than 6 times the thickness of the first ineffective layer.

This varistor has a small size and excellent surge resistance.

DESCRIPTION OF EMBODIMENTS

Figure 1A:
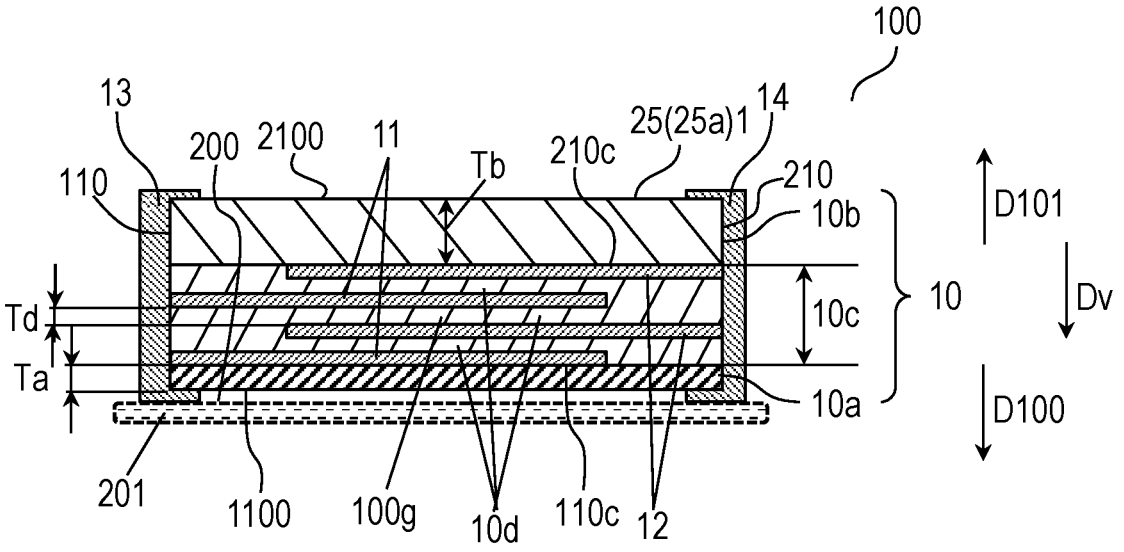
FIG. 1A is a sectional view of a varistor in accordance with an exemplary embodiment.

Each of exemplary embodiments described below is a specific example. Numerical values, shapes, materials, component elements, arrangements and connections of the component elements shown in the following exemplary embodiments are mere examples, and therefore are not intended to limit the present invention. Furthermore, among the component elements in the following exemplary embodiments, component elements not recited in any one of the independent claims which define the most generic concept are described as optional component elements. Note here that, hereinafter, the same reference numerals and symbols are given to the same or corresponding elements throughout the figures, and their duplicate explanations are omitted.

Figure 1B:
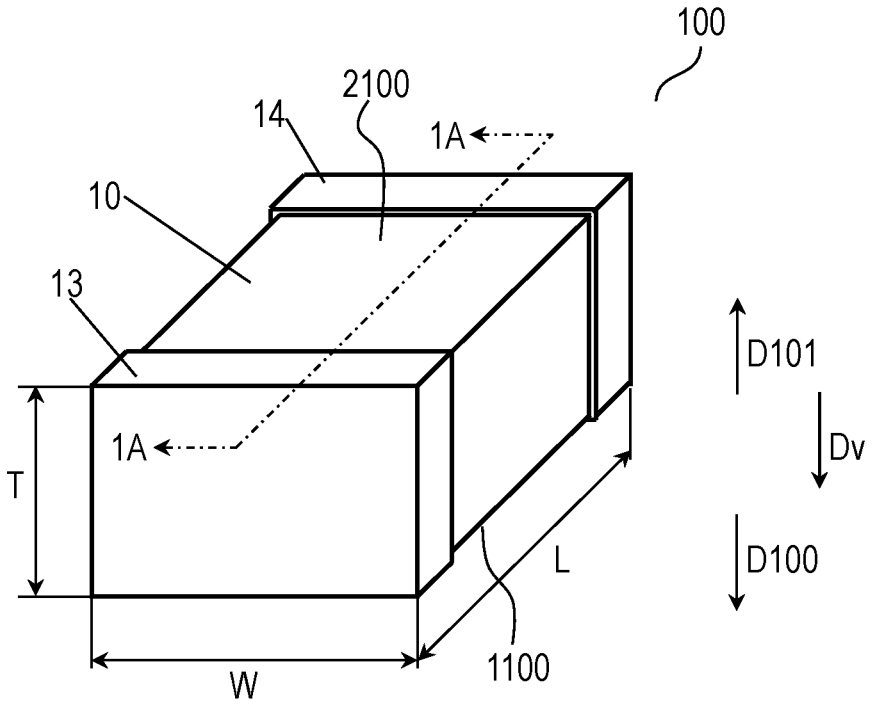
FIG. 1B is a perspective view of the varistor in accordance with the embodiment.

FIGS. 1A and 1B are a sectional view and a perspective view of varistor 100 in accordance with an exemplary embodiment, respectively. FIG. 1A shows a cross section of varistor 100 on line 1A-1A shown in FIG. 1B. Varistor 100 includes effective layer 10*c* having surfaces 110*c* and 210*c* opposite to each other, ineffective layer 10*a* stacked on surface 110*c* of effective layer 10*c* in the lamination direction D100, ineffective layer 10*b* stacked on surface 210*c* of effective layer 10*c* in the direction D101 opposite to the lamination direction D100, and external electrodes 13 and 14. Effective layer 10*c* includes ceramic layer 10*d*, internal electrodes 11 contacting ceramic layer 10*d*, and internal electrodes 12 contacting ceramic layers 10*d* and facing internal electrode 11 across ceramic layer 10*d*. Ceramic layer 10*d* and internal electrodes 11 and 12 are alternately stacked on one another to form effective layer 10*c*. Ineffective layer 10*a* is made of the same material as ceramic layer 10*d*, and contacts internal electrode 11. Ineffective layer 10*b* is made of the same material as ceramic layer 10*d*, and contacts internal electrode 12. Ceramic layer 10*d*, ineffective layer 10*b*, and ineffective layer 10*a* are integrated with one another to constitute element body 10. Internal electrode 11 is embedded in element body 10, and has an end exposed to end surface 110 of element body 10 and electrically connected to external electrode 13. Internal electrode 12 faces internal electrode 11 and is embedded in element body 10, and has an end exposed to end surface 210 of element body 10 opposite to the end surface 110 and electrically connected to external electrode 14. Element body 10 and internal electrodes 11 and 12 constitutes sintered body 25.

As shown in FIG. 1A, varistor 100 is configured to be mounted on mounting surface 200 such that surface 1100, that is, ineffective layer 10*a* faces mounting surface 200 of substrate 201. While varistor 100 is mounted on mounting surface 200 of substrate 201, ineffective layer 10*b* is positioned opposite to mounting surface 200 with respect to ineffective layer 10*a*.

Varistor 100 in accordance with the embodiment is used in applications, such as automotive applications for enhancing resistance to a high-energy surge. Breakdown due to a high energy surge is caused by a thermal damage, so that enhancement of heat dissipation is necessary for improving resistance. Hereinafter, Examples of varistor 100 in accordance with the embodiment will be described. In a device of the Examples, ineffective layer 10*a* facing the mounting surface is thin so as to enhance heat dissipation to substrate 201 from effective layer 10*c* generating heat when an abnormal voltage is applied. Ineffective layer 10*b* opposite to mounting surface 200 has a large thickness and functions as a heat sink to further enhance the heat dissipation.

The thickness Ta of ineffective layer 10*a*, the thickness Tb of ineffective layer 10*b*, the ratio Tb/Ta of the thickness Tb to the thickness Ta, and a breakdown current of each sample are shown in Table 1. In Table 1, the samples marked with "*" are Comparative Examples that are different from Examples. In the present disclosure, the nonlinearity of varistor 100 is represented as a voltage value $V_{1mA}$ (varistor voltage) between external electrodes 13 and 14 when a current of 1 mA is applied to a voltage nonlinear resistor composition. In this Example, assuming protection of an IC for automotive use, an element satisfying $V_{1mA}$=22 V is used.

TABLE 1

| Sample No. | Thickness Ta of ineffective layer 10a (μm) | Thickness Tb of ineffective layer 10b (μm) | Ratio Tb/Ta | Withstand Current (A) |
|---|---|---|---|---|
| 1 | 150 | 500 | 3.33 | 0.48 |
| 2 | 200 | 500 | 2.50 | 0.43 |
| 3 | 250 | 500 | 2.00 | 0.38 |
| 4 | 300 | 500 | 1.67 | 0.36 |
| 5 | 400 | 500 | 1.25 | 0.28 |
| *6 | 500 | 500 | 1.00 | 0.18 |
| *7 | 750 | 500 | 0.67 | 0.16 |
| *8 | 500 | 100 | 0.20 | 0.07 |
| *9 | 500 | 200 | 0.40 | 0.11 |
| *10 | 500 | 300 | 0.60 | 0.15 |
| 11 | 500 | 750 | 1.50 | 0.40 |
| 12 | 500 | 900 | 1.80 | 0.51 |
| 13 | 500 | 1200 | 2.40 | 0.45 |
| *14 | 200 | 100 | 0.50 | 0.16 |
| 15 | 200 | 300 | 1.50 | 0.46 |
| 16 | 300 | 900 | 3.00 | 0.58 |
| 17 | 300 | 600 | 2.00 | 0.41 |
| 18 | 600 | 900 | 1.50 | 0.43 |
| 19 | 750 | 900 | 1.20 | 0.24 |
| *20 | 520 | 560 | 1.08 | 0.19 |
| *21 | 690 | 730 | 1.06 | 0.20 |
| 22 | 500 | 550 | 1.10 | 0.26 |

Figure 2:
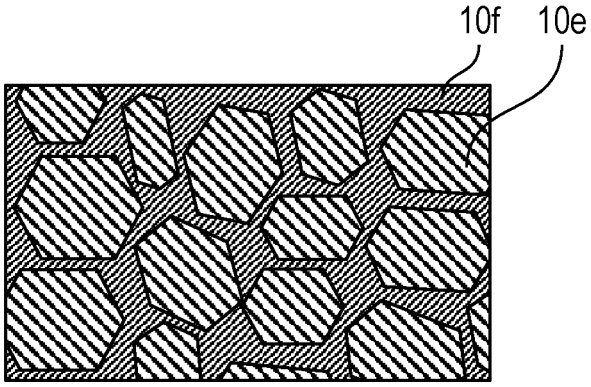
FIG. 2 is an enlarged sectional view of the varistor in accordance with the embodiment.

FIG. 2 is an enlarged sectional view of element body 10 of varistor 100 shown in FIG. 1A. Element body 10 mainly contains zinc oxide particles 10*e* and oxide layer 10*f*. Oxide layer 10*f* contains bismuth element, cobalt element, manganese element, antimony element, nickel element, and germanium element. Zinc oxide particle 10*e* has a crystal structure including a hexagonal system. Oxide layer 10*f* is disposed among zinc oxide particles 10*e*.

Element body 10 is a voltage nonlinear resistor composition containing zinc oxide particles 10*e* and oxide layer 10*f* disposed among zinc oxide particles 10*e*.

Voltage nonlinearity of varistor 100 will be described. The resistance value of a varistor rapidly decreases at a certain voltage value applied thereto. The varistor thus has a nonlinear relation between a voltage and an electric current. That is, varistor 100 preferably has a higher resistance value while the applied voltage has a low voltage value, and has a lower resistance value while the applied voltage has a high voltage value.

The resistance of varistor 100 according to the present disclosure will be detailed below.

Figure 3:
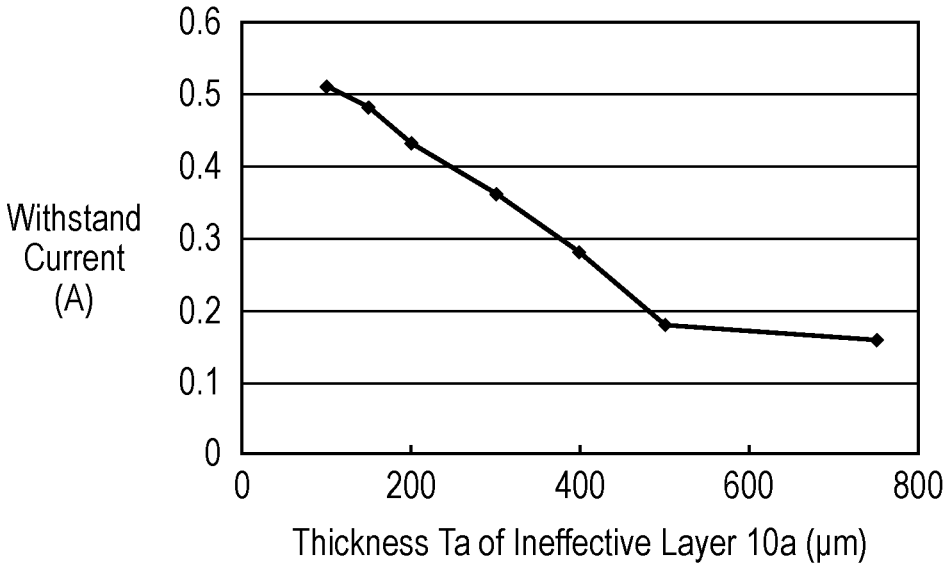
FIG. 3 shows a relation between a thickness of a first ineffective layer and a breakdown current in the varistor in accordance with the embodiment.

An influence of the thickness Ta of ineffective layer 10*a* facing mounting surface 200 on the heat dissipation to substrate 201 was studied. FIG. 3 shows breakdown currents when the thickness Ta of ineffective layer 10*a* changes from 150 to 750 μm in an element having a size of length L×width W×thickness T=3.2×2.5×1.6 (see FIG. 1B). Values shown in FIG. 3 are test results of samples Nos. 1 to 7 described in Table 1. The thickness Tb of ineffective layer 10*b* opposite to mounting surface 200 is fixed at 500 μm. The breakdown current is increased and improved with the decrease of the thickness Ta. This is because when ineffective layer 10*a* facing mounting surface 200 becomes thinner, a distance from effective layer 10*c* generating heat to surface 1100 facing mounting surface 200 is reduced, and heat is conducted to substrate 201 more easily. When the thickness Ta of ineffective layer 10*a* is reduced from 750 μm to 500 μm and the ratio Tb/Ta of the thickness Tb of ineffective layer 10*b* to the thickness Ta of ineffective layer 10*a* is increased from 0.67 to 1.00, the breakdown current is increased by 12.5% from 0.16 A to 0.18 A. When the thickness Ta of ineffective layer 10*a* is reduced from 500 μm to 400 μm, and the ratio Tb/Ta is increased from 1.00 to 1.25, the breakdown current is increased by 55.6% from 0.18 A to 0.28 A, exhibiting that the resistance to a surges is greatly improved.

Figure 4:
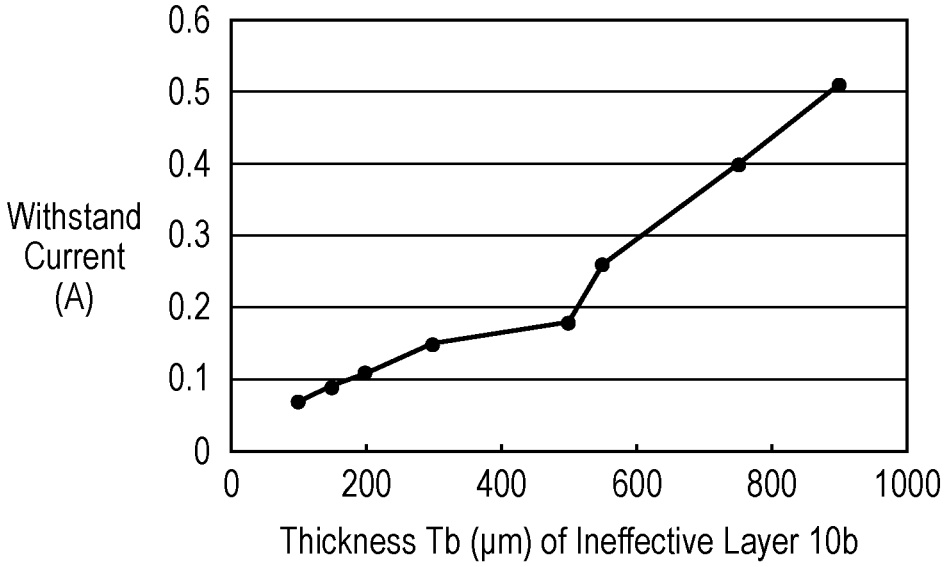
FIG. 4 shows a relation between a thickness of a second ineffective layer and a breakdown current in the varistor in accordance with the embodiment.

The increase in the size of element body 10 reduces heat dissipation from the inside of element body 10, and the varistor tends to cause thermal runaway. Further enhancement of the resistance is expected also by enhancement of the heat dissipation of the upper portion of element body 10. Element body 10 of varistor 100 in this Example has thermal conductivity of 38 W/(m·K), which is high thermal conductivity in ceramics. Therefore, the increasing of the thickness Tb of ineffective layer 10*b* opposite to mounting surface 200 allows ineffective layer 10*b* to function as a heat sink. FIG. 4 shows a relation between the thickness Tb (100-900 μm) of ineffective layer 10*b* opposite to mounting surface 200 in element body 10 having the same size and the breakdown current. The thickness Ta of ineffective layer 10*a* facing mounting surface 200 is made to be constant at 500 μm. On the contrary to ineffective layer 10*a*, the increase of the thickness Tb of ineffective layer 10*b* increases the breakdown current. This is because ineffective layer 10*b* functions as a heat sink and draws out and releases heat generated inside effective layer 10*c*. The thickness Tb of ineffective layer 10*b* is increased from 300 μm to 500 μm, and the ratio Tb/Ta of the thickness Tb of ineffective layer 10*b* to the thickness Ta of ineffective layer 10*a* is increased from 0.6 to 1.00. Then, the breakdown current is increased by 20.0% from 0.15 A to 0.18 A accordingly. The thickness Tb of ineffective layer 10*b* is increased from 500 μm to 550 μm, and the ratio Tb/Ta is increased from 1.00 to 1.10. Then, the breakdown current is increased by 44.4% from 0.18 A to 0.26 A accordingly, showing that the resistance to a surge is greatly improved. It is recognized, together with the results shown in FIG. 3, that the resistance is remarkably enhanced when the ratio Tb/Ta is equal to or larger than 1.1.

Figure 5:
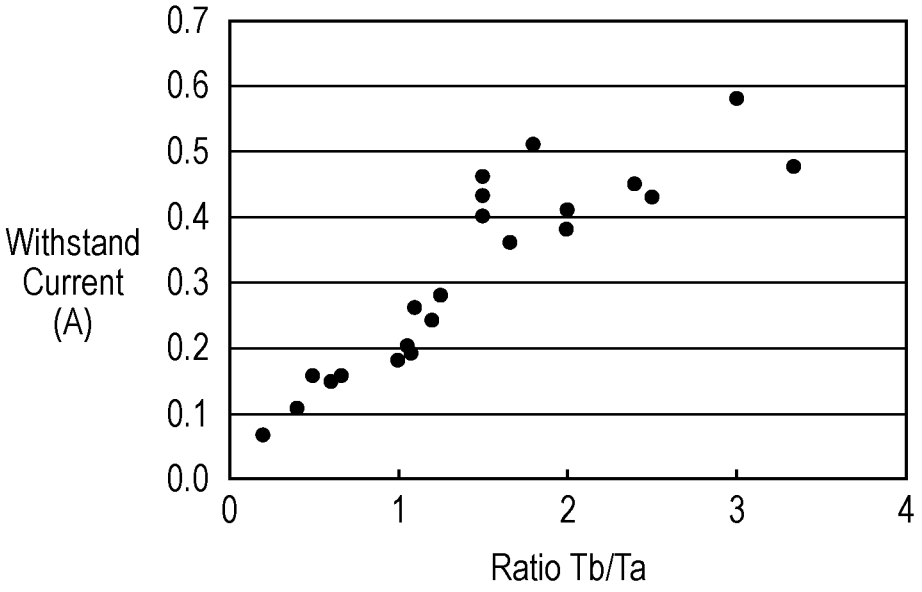
FIG. 5 shows a relation between a ratio of the thicknesses of two ineffective layers in the varistor and a breakdown current in accordance with the embodiment.

Next, the relation between the ratio Tb/Ta of the thickness Tb of ineffective layer 10*b* opposite to mounting surface 200 to the thickness Ta of ineffective layer 10*a* facing mounting surface 200 and the breakdown current will be described below. FIG. 5 shows the relation between the ratio Tb/Ta and the breakdown current. Table 1 shows combinations of the thickness Ta of ineffective layer 10*a* and a thickness Tb of ineffective layer 10*b* and the breakdown current in each of the combinations. As the ratio Tb/Ta increases, the breakdown current increases. That is, when the thickness Ta of ineffective layer 10*a* facing mounting surface 200 is small, and the thickness Tb of ineffective layer 10*b* at the opposite side is large, providing high breakdown current accordingly. The thickness Tb of ineffective layer 10*b* unpreferably exceeds 6 times the thickness Ta of ineffective layer 10*a* because the effective layer 10*c* is excessively close to ineffective layer 10*a*, shrinkage during firing of element body 10 becomes locally large in ineffective layer 10*a*, and deformation of element body 10 or crack easily occurs. In order to prevent short-circuit on surface 2100 of varistor 100, the thickness Ta of ineffective layer 10*a* is preferably larger than a thickness Td (see FIG. 1A) of ceramic layer 10 contacting and sandwiched between adjacent internal electrodes among plural internal electrodes 11 and 12. The thickness Tb of ineffective layer 10*b* that is equal to or larger than twice the thickness Ta of ineffective layer 10*a* causes the position of effective layer 10*c* to deviate toward ineffective layer 10*a* from the center portion. This deviation causes center of gravity 100*g* of varistor 100 to be close to a surface 1100 because internal electrodes 11 and 12 have a higher density than element body 10. That is, the distance from center of gravity 100*g* to surface 1100 is smaller than the distance from center of gravity 100*g* to surface 2100. This configuration preferably aligns directions of the ineffective layers 10*a* and 10*b* easily in production process.

Next, a method for producing varistor 100 will be described below.

Figure 6:
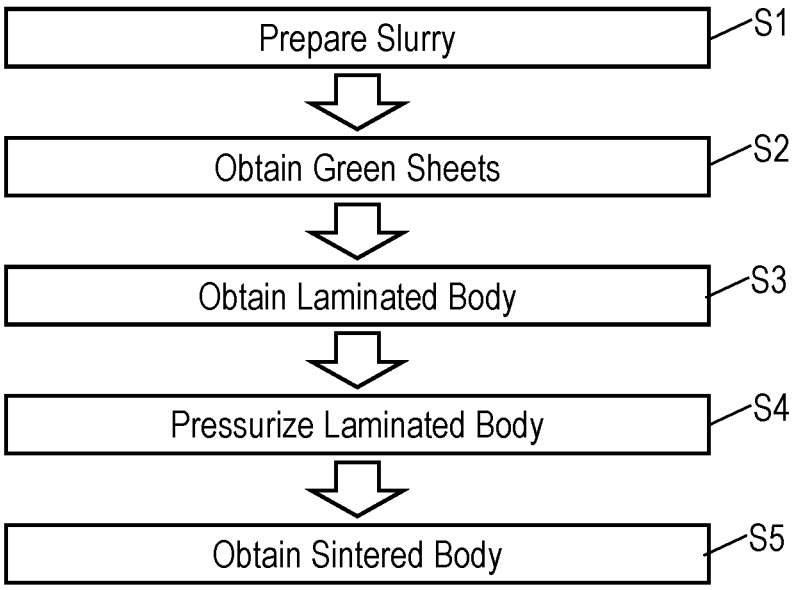
FIG. 6 is a flowchart showing a method for producing a varistor in accordance with the embodiment.

FIG. 6 is a flowchart showing processes for producing varistor 100.

Firstly, zinc oxide powder, bismuth oxide powder, cobalt oxide powder, manganese oxide powder, antimony oxide powder, nickel oxide powder, and germanium oxide powder are prepared as a starting material of element body 10.

The starting materials contains 96.54 mol % of zinc oxide powder, 1.00 mol % of bismuth oxide powder, 1.06 mol % of cobalt oxide powder, 0.30 mol % of manganese oxide powder, 0.50 mol % of antimony oxide powder, 0.50 mol % of nickel oxide powder, and 0.10 mol % of germanium oxide powder. Slurry containing these powders and an organic binder is prepared (step S1).

Next, a process for obtaining green sheets will be described below.

Figure 7:
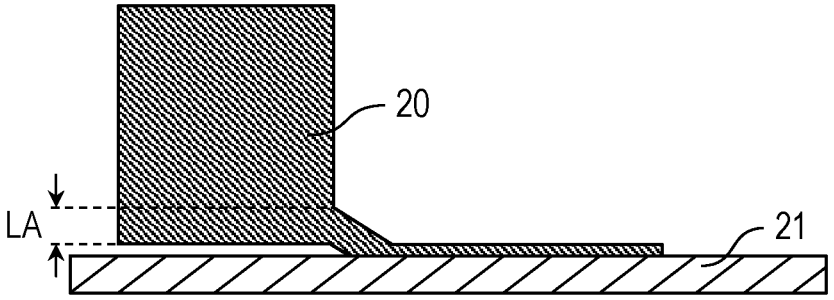
FIG. 7 is a sectional view of a production apparatus for producing a varistor in accordance with the embodiment.

FIG. 7 is a sectional view of an apparatus, and schematically shows a process of obtaining the green sheets.

Slurry 20 described above is applied to film 21 made of polyethylene terephthalate (PET) through a gap having a width LA of 180 μm and dried, thereby providing green sheets (step S2).

Next, electrode paste containing alloy powder of silver and palladium is printed in a predetermined shape on a predetermined number of the green sheets, and only a predetermined number of these green sheets are stacked on one another in a lamination direction D100 perpendicular to surface directions of the green sheets (see FIG. 1A) to obtain a laminated body (step S3). At this moment, the thickness Ta is adjusted such that the thickness Tb of ineffective layer 10*b* and the thickness Ta of ineffective layer 10*a* are predetermined values by adjusting the number of stacked green sheets on which the electrode paste has not been printed.

Next, this laminated body is pressurized at 55 MPa in the lamination direction D100 and the direction D101 (step S4). The pressure here may be preferably equal to or larger than 30 MPa and equal to or smaller than 100 MPa. The laminated body pressurized at a pressure equal to or larger than 30 MPa increases adhesion of the green sheets, and provides an element with no structural defects. The laminated body pressurized at a pressure equal to or smaller than 100 MPa maintains its shape. In the case that materials of ineffective layer 10*a* and ineffective layer 10*b* are different from that of effective layer 10*c*, the pressure is preferably applied isotropically by warm isotropic press, thereby providing preventing structural defects, such as crack or deformation of an element. Then, the obtained laminated body is cut into each element size to produce chips of laminated bodies 25*a* (see FIG. 1A).

Next, a chip of laminated body 25*a* is fired at 850° C. to obtain sintered body 25 (see FIG. 1A) including element body 10 (voltage nonlinear resistor composition), internal electrode 11, and internal electrode 12 (step S5). This firing changes zinc oxide powders as starting raw materials into zinc oxide particles 10*e* shown in FIG. 2, thus providing a voltage nonlinear resistor body including oxide layer 10*f* disposed among zinc oxide particles 10*e*.

Next, electrode paste including alloy powder of silver and palladium is applied to end surfaces 210 and 220 of element body 10, and then heated at 800° C., thereby forming external electrodes 13 and 14, respectively. External electrodes 13 and 14 may be formed by a plating method. External electrodes 13 and 14 may be a combination of an external electrode formed by firing the electrode paste and an external electrode formed by a plating method.

In this Example, a thickness of element body 10 is determined such that $V_{1mA}$ of a sample of varistor 100 was 22 V (±2 V), and firing conditions were determined so that the material constant after firing was the same. As to the resistance, a sample of varistor 100 was mounted on substrate 201 by solder, and a breakdown current when a direct-current (DC) voltage was applied, i.e., a current at the time when thermal runaway starts was measured, and evaluated.

In order to mount varistor 100 such that ineffective layer 10*a* faces mounting surface 200, the upside-downside positional relation of ineffective layers 10*a* and 10*b* are previously aligned to a predetermined relation. For example, when the upside-downside relation of the lamination direction D100 is identical to predetermined direction Dv, the positional relation of ineffective layers 10*a* and 10*b* becomes a predetermined relation without a process of aligning the direction of varistor 100 when varistor 100 is placed in a carrier tape to be attached to a mounting machine. When ineffective layer 10*a* is thinner than ineffective layer 10*b*, center of gravity 100*g* of varistor 100 deviates toward ineffective layer 10*a*. That is, center of gravity 100*g* is closer to surface 1100 than to surface 2100.

Figure 8:
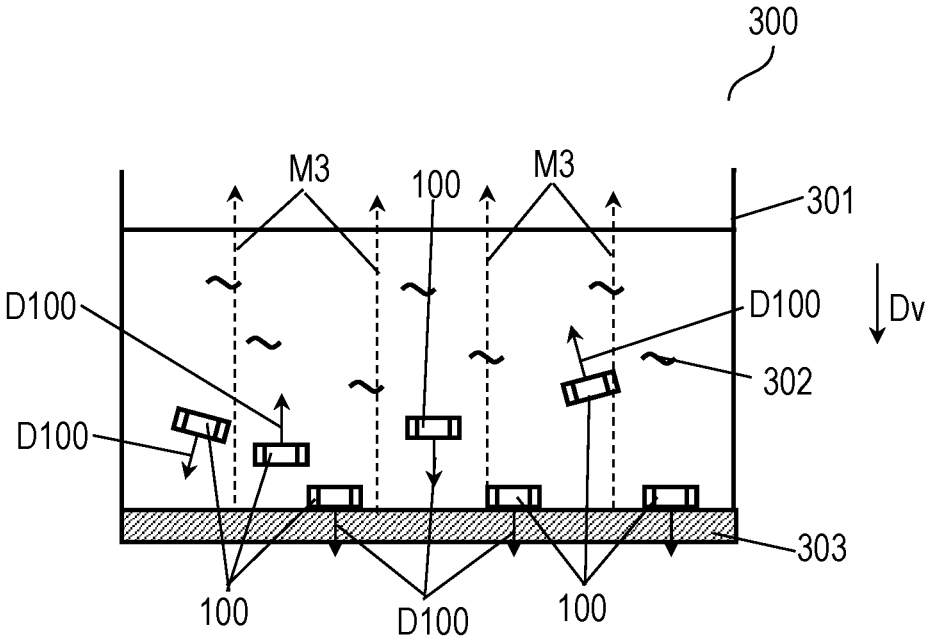
FIG. 8 is a schematic diagram of the production apparatus for producing a varistor in accordance with the embodiment.

FIG. 8 is a schematic view of production apparatus 300 of varistor 100. Production apparatus 300 includes storage tank 301 configured to store liquid 302. As described above, when external electrodes 13 and 14 are plated, varistor 100 is placed in liquid 302 as a plating solution. At this moment, even if the upside-downside relation of ineffective layers 10*a* and 10*b* is not aligned, surface 100 closer to center of gravity 100*g*, that is, ineffective layer 10*a* is located in the lower part in liquid 302 by its own weight, the upside-downside relation of ineffective layers 10*a* and 10*b* becomes a predetermined relation, that is, the lamination direction D100 becomes identical to predetermined direction Dv. This configuration is suitable for a mass-production line. In the exemplary embodiment, the predetermined direction Dv is a vertical direction. A process for causing lamination direction D100 to identical to the predetermined direction Dv may be executed after the process of plating.

Production apparatus 300 may further include magnet 303 provided to storage tank 301. In a case where internal electrodes 11 and 12 contain magnetic metal, such as Ni, when varistor 100 approaches magnet 303, thin ineffective layer 10*a* configured to face mounting surface 200 is attracted to magnet 303. Therefore, the upside-downside relation of ineffective layers 10*a* and 10*b* becomes a predetermined relation. Furthermore, in addition to magnet 303, a process of applying magnetic field M3 to varistor 100 in liquid 302 may be added. Since this process is easily introduced into a mass production step, varistor 100 of this Example is suitable for the mass production.

Liquid 302 is not necessarily a plating solution. Since the above-mentioned process may be executed for other liquids, the above-mentioned process may be performed to varistor 100 which has not undergone plating.

Magnetic field M3 is not necessarily applied into liquid 302, and may be applied into the air by, for example, adding vibration, thereby allowing the vertical upside-downside relation of ineffective layers 10*a* and 10*b* may become a predetermined relation.

The thickness Tb of ineffective layer 10*b* is preferably equal to or larger than twice the thickness Ta of ineffective layer 10*a* since the position of effective layer 10*c* deviates toward ineffective layer 10*a* from the center portion, and the position of center of gravity 100*g* deviates, easily causing the lamination direction D100 to be identical to the predetermined direction in the production process.

The zinc oxide varistor is a ceramic polycrystal obtained by adding additive, such as a bismuth element or praseodymium element, to zinc oxide and sintered. The effect of protecting devices from a surge with a high energy amount is not expected by increasing the size of the element and an area of internal electrodes. Conventional varistors hardly have sufficient surge resistance in large current region.

Varistor 100 in accordance with the embodiment has a small size and excellent surge resistance, as mentioned above.

REFERENCE MARKS IN THE DRAWINGS

10 element body
10*a* ineffective layer (first ineffective layer)
10*b* ineffective layer (second ineffective layer)
10*c* effective layer
10*d* ceramic layer
11 internal electrode
12 internal electrode
13 external electrode
14 external electrode
100 varistor
302 liquid
303 magnet
M3 magnetic field

The invention claimed is:

1. A varistor comprising:

an effective layer having a first surface and a second surface opposite to each other, the effective layer including one or more ceramic layers having a polycrystalline structure including a plurality of crystal particles exhibiting voltage nonlinear characteristics, and a plurality of internal electrodes stacked alternately on the one or more ceramic layers;

a first ineffective layer stacked on the first surface of the effective layer;

a second ineffective layer stacked on the second surface of the effective layer; and a first external electrode and a second external electrode which are electrically connected to the plurality of internal electrodes, wherein a thickness of the second ineffective layer is equal to or more than 1.1 times a thickness of the first ineffective layer and equal to or smaller than 6 times the thickness of the first ineffective layer.

2. The varistor according to claim 1, wherein the varistor is configured to be mounted on a mounting surface such that the first ineffective layer faces the mounting surface and the second ineffective layer is positioned opposite to the mounting surface with respect to the first ineffective layer.

3. The varistor according to claim 1, wherein the plurality of internal electrodes includes a first internal electrode and a second internal electrode which are adjacent to each other and connected to the first external electrode and the second external electrode, respectively, and the thickness of the first ineffective layer is larger than a thickness of a ceramic layer out of the one or more ceramic layers which is sandwiched between the first internal electrode and the second internal electrode.

4. The varistor according to claim 1, wherein the thickness of the second ineffective layer is equal to or more than twice the thickness of the first ineffective layer and equal to or smaller than 6 times the thickness of the first ineffective layer.

5. A method for producing a varistor, comprising:

providing a sintered body including an effective layer having a first surface and a second surface opposite to each other, the effective layer including one or more ceramic layers and a plurality of internal electrodes stacked alternately on the one or more ceramic layers, the one or more ceramic layers having a polycrystalline structure including a plurality of crystal particles exhibiting voltage nonlinear characteristics, a first ineffective layer stacked on the first surface of the effective layer in a lamination direction, and a second ineffective layer stacked on the second surface of the effective layer in a direction opposite to the lamination direction, wherein a thickness of the second ineffective layer is equal to or more than 1.1 times a thickness of the first ineffective layer and equal to or smaller than 6 times the thickness of the first ineffective layer;

forming an external electrode provided on an end surface of the sintered body and electrically connected to one of the plurality of internal electrodes; and positioning the sintered body such that the lamination direction is identical to a predetermined direction.

6. The method according to claim 5, further comprising plating the external electrode in a plating solution, wherein said positioning the sintered body comprises allowing the lamination direction to be identical to the predetermined direction while placing the sintered body in the plating solution.

7. The method according to claim 6, said allowing the lamination direction to be identical to the predetermined direction is executed after said plating.

8. The method according to claim 6, wherein the internal electrode contains magnetic metal, and said positioning the sintered body comprises allowing the lamination direction to be identical to the predetermined direction by applying a magnetic field to the sintered body while the sintered body is placed in the plating solution.

9. The method according to claim 8, wherein said allowing the lamination direction to be identical to the predetermined direction is executed after said plating.

10. The method according to claim 5, wherein the internal electrode contains magnetic metal, and said positioning the sintered body comprises allowing the lamination direction to be identical to the predetermined direction by applying magnetic field to the sintered body.

11. The method according to claim 10, wherein said allowing the lamination direction to be identical to the predetermined direction comprises allowing the lamination direction to be identical to the predetermined direction by applying the magnetic field to the sintered body while the sintered body is placed in a liquid.

12. The method according to claim 5, wherein said providing the sintered body comprises:

providing material powder of ceramic having the polycrystalline structure;

preparing slurry containing the material powder and organic solvent;

providing a plurality of green sheets by applying the slurry on a film;

providing a laminated body by stacking the plurality of green sheets and a plurality of electrode pastes being to constitute the plurality of internal electrodes, the plurality of electrode pastes being made of electrode paste; and providing the sintered body by firing the laminated body.

13. The method according to claim 5, wherein said forming the external electrode comprises:

applying metal paste to the sintered body; and heating the applied metal paste.

* * * * *